US008292383B2

(12) United States Patent
Laible

(10) Patent No.: US 8,292,383 B2
(45) Date of Patent: Oct. 23, 2012

(54) REFRIGERATING DEVICE COMPRISING TWO DOORS

(75) Inventor: Karl-Friedrich Laible, Langenau (DE)

(73) Assignee: BSG Bosch und Siemens Hausgeraete GmbH, Munich (DE)

( * ) Notice: Subject to any disclaimer, the term of this patent is extended or adjusted under 35 U.S.C. 154(b) by 581 days.

(21) Appl. No.: 12/225,953

(22) PCT Filed: Mar. 5, 2007

(86) PCT No.: PCT/EP2007/052043

§ 371 (c)(1),
(2), (4) Date: Oct. 3, 2008

(87) PCT Pub. No.: WO2007/115868

PCT Pub. Date: Oct. 18, 2007

(65) Prior Publication Data

US 2009/0113927 A1 May 7, 2009

(30) Foreign Application Priority Data

Apr. 5, 2006 (DE) ..... 10 2006 015 991

(51) Int. Cl.
*A47B 96/04* (2006.01)

(52) U.S. Cl. ..... 312/405; 312/329; 49/366; 49/367; 49/368; 49/365

(58) Field of Classification Search ..... 312/405, 312/326, 329, 324, 296, 407; 49/366, 367, 49/368, 365

See application file for complete search history.

(56) References Cited

U.S. PATENT DOCUMENTS 4,288,135 A * 9/1981 Buchser et al. ..... 312/296
4,428,153 A * 1/1984 Klinger et al. ..... 49/366
4,711,098 A * 12/1987 Kuwabara et al. ..... 62/441
5,411,328 A * 5/1995 You ..... 312/405
5,694,789 A * 12/1997 Do ..... 62/441

(Continued)

FOREIGN PATENT DOCUMENTS

JP 2-21181 1/1990

(Continued)

OTHER PUBLICATIONS

International Search Report PCT/EP2007/052043.

*Primary Examiner* — Darnell Jayne
*Assistant Examiner* — Daniel Rohrhoff
(74) *Attorney, Agent, or Firm* — James E. Howard; Andre Pallapies

(57) ABSTRACT

A refrigerator includes a body, a first door and a second door, where one of their edges is fixed to the opposite side of the opening of the body, and a beam which is joined to one edge of the first door which is opposite the fixed edge of the door. The beam can be pivoted by a guiding projection which can be displaced in a guiding groove on the edge of the opening, between a position when the first door is closed, in which one edge of the second door, which is opposite the fixed edge of said door, is applied to the beam, and a position when the first door is open, wherein the beam can pass to the closed second door. The guiding projection can be displaced in relation to the first door in the direction of the pivotable axis thereof.

20 Claims, 3 Drawing Sheets

U.S. PATENT DOCUMENTS

| | | | | |
|---|---|---|---|---|
| 7,008,032 | B2 * | 3/2006 | Chekal et al. | 312/405 |
| 7,506,474 | B2 * | 3/2009 | Yoshikawa et al. | 49/257 |
| 2005/0046319 | A1 * | 3/2005 | Chekal et al. | 312/401 |
| 2009/0113927 | A1 * | 5/2009 | Laible | 62/449 |
| 2009/0273264 | A1 * | 11/2009 | Butler | 312/405 |

FOREIGN PATENT DOCUMENTS

| | | |
|---|---|---|
| JP | 2-192578 | 7/1990 |
| JP | 8-136115 | 5/1996 |

* cited by examiner

REFRIGERATING DEVICE COMPRISING TWO DOORS

BACKGROUND OF THE INVENTION

The present invention relates to a refrigerating device comprising a body and two doors, where one of their respective edges is fixed to the opposite side of the opening of the body.

With such a refrigerating device, there is the problem of a beam which extends across through the opening of the body being needed in order to be able to create a support surface against which the doors, in a closed position, can rest in a sealed fashion. If such a beam is fixedly mounted in the body, it thus prevents access to the interior of the refrigerating device if both doors are open at the same time. If the beam is rigidly fastened to one of the doors, only this door can be opened if the other door is already open, which likewise prevents free access to the interior.

U.S. Pat. No. 4,711,098 discloses a two door refrigerating device, in which a beam is joined to one edge of the first door, which is opposite the fixed edge of said door. The beam can be pivoted between a first position, in which the closed second door rests tightly thereagainst, and a second position, in which it pivots completely behind the first door, so that this can be opened without having to take the second door with it. The pivoting movement of the beam is guided by means of a guiding projection of the beam, which can be displaced in a guiding groove formed on the edge of the opening of the body and compels the beam to perform a pivoting movement which is coupled to the opening movement of the first door.

One problem of this refrigerating device is that the beam must have a degree of play in its longitudinal direction in order to reliably engage it into the opening of the body when closing the first door. I.e. a gap must exist between the front faces of the beam and a surface of the body facing these front faces, in which the guiding groove is formed, as well as between the tips of the guiding projection and the base of the groove, into which it engages, the width of said gap in practice amounting to several millimeters. Provided a side wall of the projection does not rest its entire length in a sealed fashion against a side wall of the groove, when the doors are closed, air can also flow into the interior of the refrigerating device. The significant supply of heat and moisture resulting herefrom renders the energy consumption of the refrigerating device high.

BRIEF SUMMARY OF THE INVENTION

It is thus important to create a two door refrigerating device with a pivotable beam, which allows reliable sealing of the doors despite play in the longitudinal direction of the beam. The object is achieved in accordance with the invention in that with a refrigerating device comprising a body, a first door and a second door, where one of their respective edges is fixed to the opposite side of the opening of the body, and a beam, which is joined to one edge of the first door which is opposite the fixed edge of said door and which can be pivoted with the aid of a guiding projection which can be displaced in a guiding groove formed on the edge of the opening, between a position adopted when the first door is closed, in which one edge of the second door, which is opposite the fixed edge of said door, is applied to the beam, and a position which is adopted when the first door is open, wherein the beam can traverse to the closed second door. The guiding projection can be displaced in relation to the first door in the direction of the pivotable axis thereof. This allows the guiding projection to avoid the pivotable axis of the door, if necessary, when closing the first door. Despite potential tolerances when suspending the door, it can thus be ensured that the tip of the guiding projection makes contact with the base of the guiding groove, so that no external air can pass through the guiding projection into the interior of the refrigerating device.

In general, provision is made for guiding projections and guiding grooves on both longitudinal ends of the beam and/or surfaces of the body facing said beam. With at least one such guiding projection, it is possible for said guiding projection to be fixedly connected to the beam and displaceable together with this in the direction of the pivotable axis of the door. In order however to keep the displacing mass small when engaging the beam into the opening of the body, the guiding projection is generally also made displaceable in relation to the beam in the direction of the pivotable axis of the first door.

The axial displaceability of the guiding projection is preferably realized by displaceably guiding the arc-shaped guiding projection in the cross-section into a channel of the beam which comprises a complementary cross-section.

To facilitate engaging the beam into the opening of the body, an insertion bevel is preferably formed on one region of the guiding projection which engages in the guiding groove when closing the first door, in which insertion bevel, when measured in the direction of the pivotable axis, the height of the guiding projection reduces towards its end.

To avoid leakages on the guiding groove, the guiding projection is to insert its entire length into the guiding groove in the position of the beam which is adopted when the first door is closed.

It is also expedient for sealing purposes for the guiding groove to have a beveled base section, which makes contact with the insertion bevel if the beam is located in the position adopted when the first door is closed.

Alternatively or in addition to an insertion bevel of the guiding projection, an insertion bevel can also be provided on the guiding groove, in which the depth of the groove increases towards one open end of the same.

The guiding projection is preferably impinged upon by a spring outwards in the direction of the pivotable axis.

BRIEF DESCRIPTION OF THE DRAWINGS

Further features and advantages of the invention result from the description that follows of exemplary embodiments with reference to the appended Figures, in which.

DETAILED DESCRIPTION OF THE PRESENT INVENTION

Figure 1:
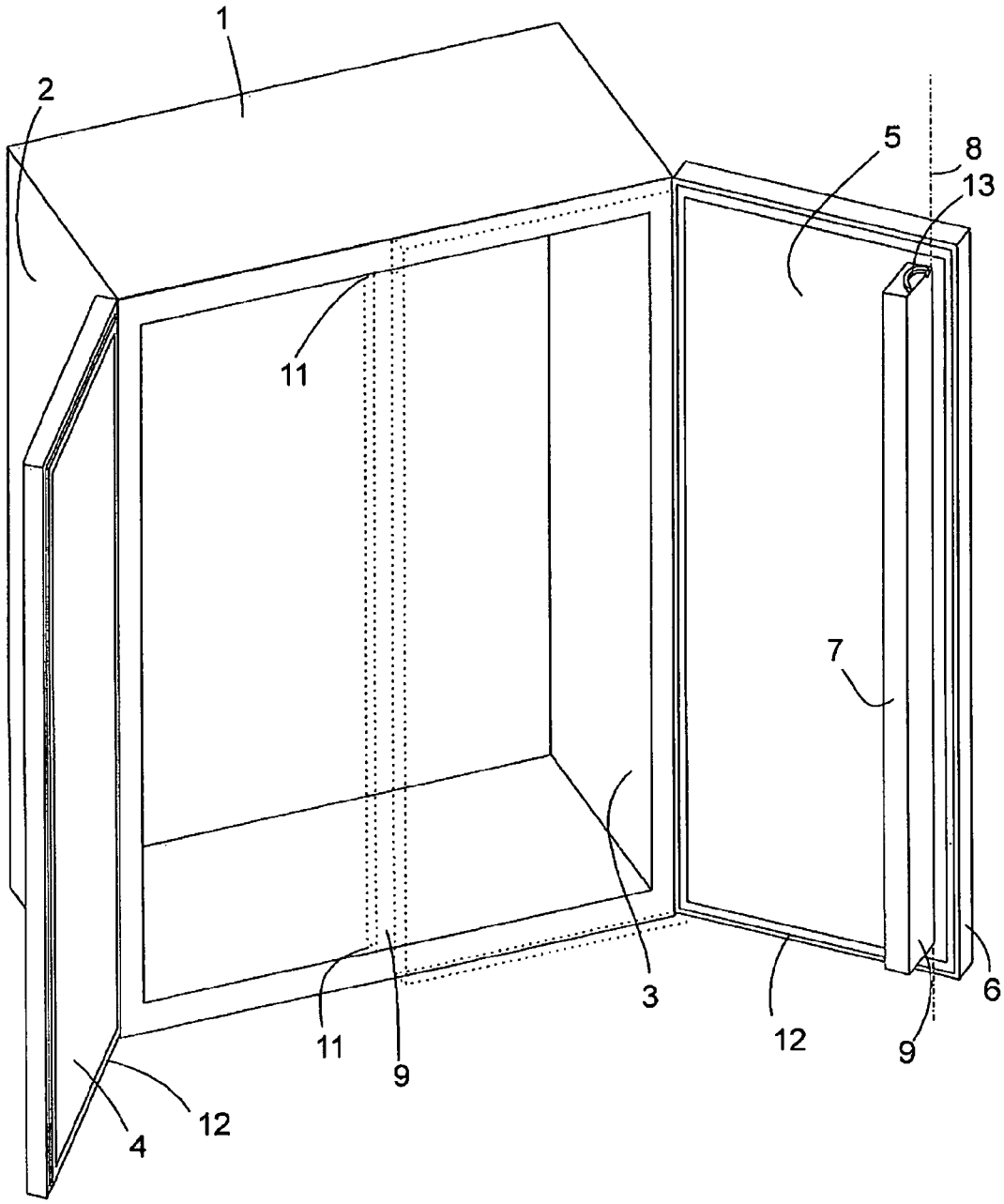
FIG. 1 shows a schematic view of a refrigerating device according to the invention.

FIG. 1 shows a perspective view of a refrigerating device comprising a body 1 and doors 4, 5 fixed to side walls 2, 3 of the body 1. The left door 4 is shown in an open position, the right door 5 with a solid line in an open position and with a dashed line in a closed position. A beam 7 is joined to the interior of the door 5, adjacent to its edge 6 facing away from the door hinge, so as to be pivotable about a vertical axis 8. In the open position of the door 5, a narrow side of the rectangular beam 7 in the cross-section is pivoted against the interior of the door 5, so that the beam 7 does not laterally protrude beyond the edge 6. When closing the door 5, the beam 7 can thus traverse the door 4, if this rests against the body 1 in a closed state. When closing the door 5, the beam 7 engages in the interior of the body and in the process pivots about the axis 8, so that a wide side 9 thereof enters the opening of the body 1 and rests flush with the frame 10 thereof. In this position, the frame 10 and the wide side 9 form a support surface which passes between the ends of the beam 7 and the base and/or ceiling of the body 1 up to a narrow gap 11, on which support surface magnetic sealings 12 of the doors 4, 5 are attached in a sealed fashion. The widths of the gap 11 are measured in order to ensure that when closing the door, the beam 7 is reliably able to engage in the body opening without its ends colliding with the base or ceiling of the body. The width required for this can vary depending on the stability of the body and the doors and as a function of whether the doors are used as fasteners for (not shown in the Figure) refrigerated goods carriers. The width of the gap 11 generally amounts to a few millimeters in practice.

Two guiding projections 13 are attached in a vertically displaceable fashion to the ends of the beam 7, with only the guiding projection 13 of the upper end being visible in the perspective in FIG. 1. The guiding projections 13 each have an arched cross-section, with the two ends of the arch ending with the wide side 9 of the beam 7. The height of the guiding projection 13 is greater than the width of the gap 11, so that the guiding projections 13 strike the ceiling and base of the body when closing the door 5.

Figure 2:
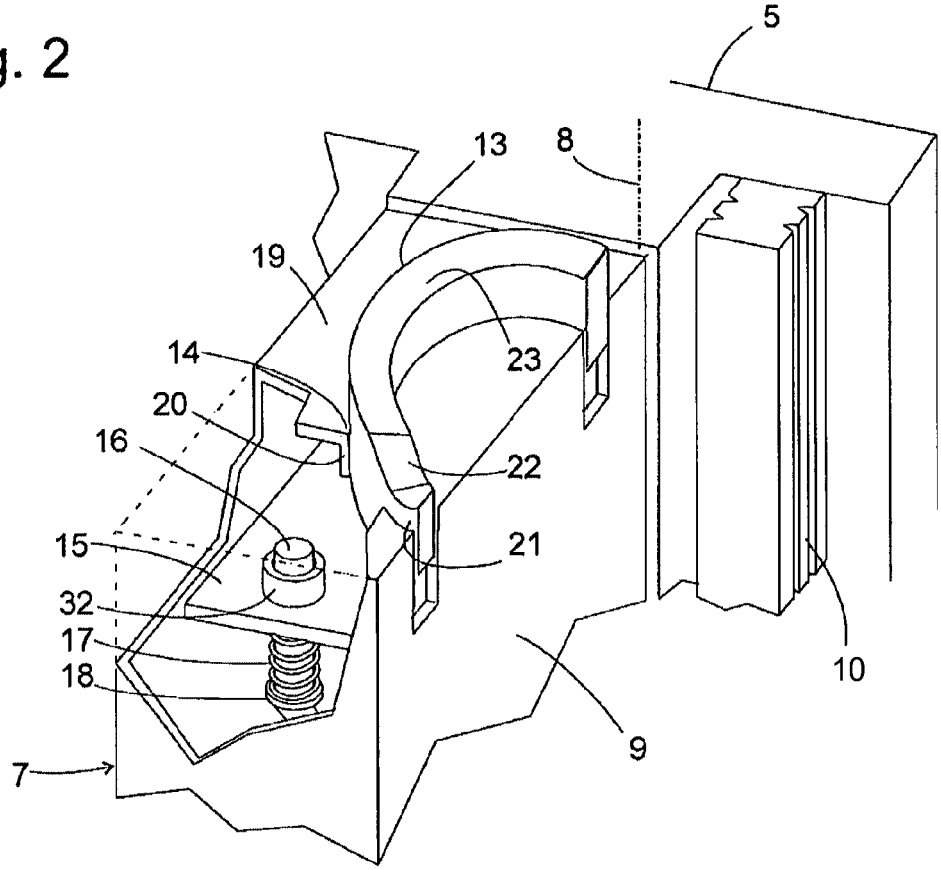
FIG. 2 shows a partially opened out view of the upper end of the beam.

As shown in FIG. 2 in the example of the upper guiding projection 13, the two guiding projections 13 are guided in a vertically displaceable fashion in a slit 14 of the beam 7 in each instance. In more precise terms, the guiding projection 13 is fixedly connected to a base plate 15 and two pins 16 fixed on the beam 7, only one of which is visible in FIG. 2, extend through sleeves 32 on opposite ends of the base plate 15. Spiral springs 17, which are positioned on the pin 16 and are supported on a circumferential shoulder 18 of the pin 16, allow the base plate 15 to be press against a front wall 19 of the beam 7. Ridges 20 protruding from the front wall 19 around the slit 14 inside the beam 7 are used on the one hand to guide the projection 13 in the vertical direction and on the other hand as a stop for the base plate 15 thereof.

When closing the door 5, the end 21 of the guiding projection 13 which faces the observer is the first to enter into the opening of the body. The height of the guiding projection 13 is minimal at one end 21. It gradually increases from there along an insertion bevel 22, in order to remain constant on one main section 23 of the guiding projection 13. The height of the guiding projection 13 is larger over its entire length than the width of the gap, into which the door enters 5 when closing.

The configuration of the lower guiding projection 13 (not shown) is a mirror image in respect of that in FIG. 2.

Figure 3:
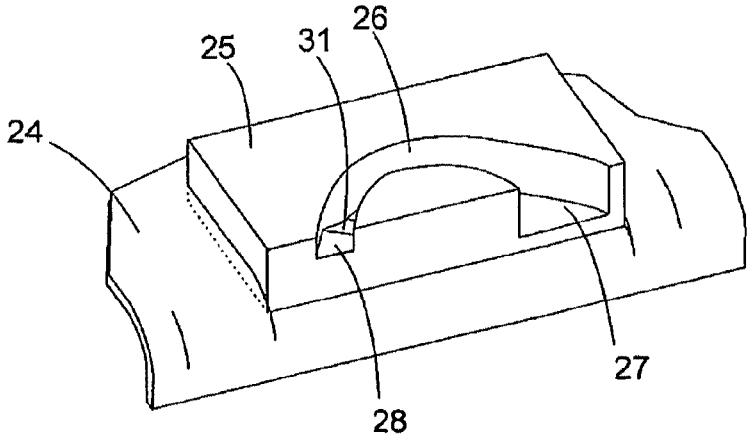
FIG. 3 shows a guiding groove for guiding a guiding projection protruding from the lower end of the beam and the surroundings thereof.

FIG. 3 shows one section of the base of the body 1 from the same visual direction as in FIG. 1. The base is formed by a plate 24 deep-drawn from plastic, in which a flat niche is formed, which receives a guiding block 25. A curved guiding groove 26 which is complementary to the guiding projection 13 runs on the upper side of the guiding block 25. The guiding groove 26 has a funnel-shaped extended input opening 27, which opens out into the front side of the guiding block 25 and into which the guiding projection 13 engages with its end 21 upon the door being closed. One end 28 of the guiding groove 26 opposite to the input opening 27 likewise opens out onto the front side of the block 25.

Figure 4:
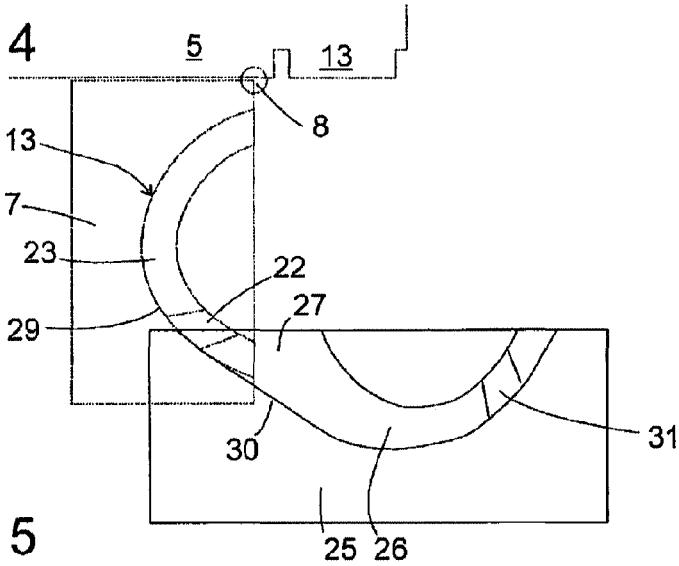
FIGS. 4-6 show schematic representations of the movement of the beam when closing the door.
Figure 6:
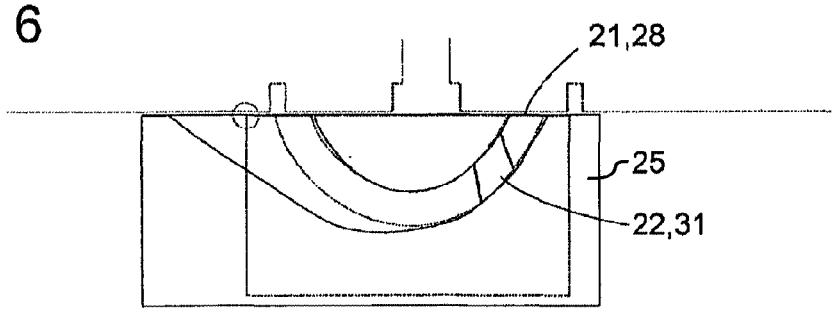

FIGS. 4 and 6 illustrate, on the basis of schematic sections, the closing process of the door 5. In these Figures, the doors 4, 5 and moveable parts thereof, are shown with dashed lines, whereas the fixed guiding block 25 is shown with a solid line. The following description applies in respect of the lower guiding body 25 and the guiding projection 13 engaging therein, whereby it should be understood that mirror-inverted similar conditions are present on the upper guiding body 25.

FIG. 4 shows one stage of the closing movement of the door 5, in which the beam 7 with a narrow side rests against the interior of the door 5, and the insertion bevel 22 of the guiding projection 13 which faces away from the door 7 begins to engage into the input opening 27 of the guiding block 25 and a convex side edge 29 of the guiding projection 13 begins making contact with a side wall 30 of the guiding groove 26 which faces the body interior.

With further closure of the door 5, the side edge 29 slides along the wall 30, as a result of which the beam 7 is pivoted. At the same time, shortly before or after the stage in FIG. 4, the insertion bevel 22 makes contact with the base of the guiding groove 26 on the input opening 27 thereof, so that when continuing the closing movement, the guiding projection is forced upward and into the beam 7. The displacement of the guiding projection 13 upwards ends as soon as the insertion bevel 22 has passed the input of the guiding groove 26 and the unvaryingly high main section 23 slides onto the base of the groove 26.

Figure 5:
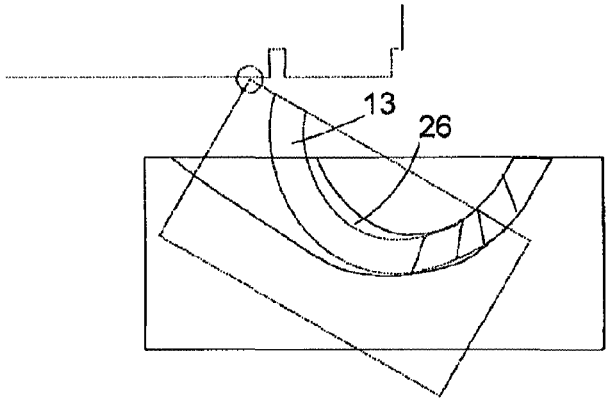

In the stage in FIG. 5, the guiding projection 13 is engaged into the groove 26 over a large part of its length.

With a fully closed door 5, as shown in FIG. 6, the guiding end 21 of the guiding projection 13 is located at the end 28 of the guiding groove 26 and closes flush with the front side of the guiding block 25. The insertion bevel 22 of the guiding projection 13 is positioned on a beveled section 31 of the base of the groove 26. The guiding projection 13 makes contact with the base of the groove 26 over its entire length and thus blocks the gap 11 in an air-tight fashion without the side edges of the guiding projection 13 being clamped between the walls of the groove 26, and one of the side edges must to rest against a side wall of the groove 26 over its entire length. When inserting the guiding projection 13 into the guiding groove 26, frictional resistance to be overcome can be kept to a minimum and the final position of FIG. 6 in which the guiding end 21 of the guiding projection 13 is flush with the front end of the guiding block 25, is reliably reached. A flat support surface is thus achieved, which extends from the frame via the end 21 of the guiding projection bridging the gap 11 to the beam 7 and can be tightly connected to the magnetic sealing 12 of the door 4.

The invention claimed is:

1. A refrigerating device comprising:

a body, the body having a pair of interior edges disposed opposite to one another and together delimiting an opening in the body, and the body having a guiding groove;

a first door, the first door having an anchor edge secured to one of the interior edges of the body and a free edge opposite to its anchor edge;

a second door, the second door having an anchor edge secured to the other interior edge of the body and a free edge opposite to its anchor edge, the first door and the second door each being movable between a respective open disposition and a respective closed disposition;

a beam, the beam being movably secured to the first door proximate to the free edge of the first door and the beam being movable relative to the first door about a beam movement axis between a traversing position, when the first door and the second door are in their respective closed dispositions, in which the beam traverses the opening of the body and in which the second door can, in the region of its free edge, engage the beam, and a non-traversing position, when the first door is in its open disposition; and a guiding projection movably mounted on the first door, the guiding projection being movable relative to the first door in a direction generally parallel to the beam movement axis and the guiding projection of the first door and the guiding groove of the body engaging one another as the first door is moved from its open disposition into its closed disposition with engagement between the guiding projection of the first door and the guiding groove of the body assisting a movement of the beam from its non-traversing position into its traversing position, wherein the guiding projection has an arc-shaped cross section and the guiding projection is guided in a displaceable manner in a channel of the beam formed with a complementary arc-shaped cross-section.

2. The refrigerating device as claimed in claim 1, wherein the guiding projection is additionally movable relative to the beam in a direction generally parallel to the beam movement axis.

3. The refrigerating device as claimed in claim 1, wherein the guiding projection on the first door includes an insertion bevel formed on the respective region of the guiding projection that initially engages the guiding groove of the body when the first door is closed, and the insertion bevel has a progressively reducing height in a direction from an entry portion thereof that is the first portion of the guiding projection to enter the guiding groove of the body towards an end portion of the guiding projection that thereafter enters the guiding groove of the body.

4. The refrigerating device as claimed in claim 3, wherein, in the traversing position of the beam, the entire length of the insertion bevel has seated into the guiding groove of the body.

5. The refrigerating device as claimed in claim 3, wherein the guiding groove has a beveled base section that engages with the insertion bevel as the beam is moved into its traversing position.

6. The refrigerating device as claimed in claim 1, wherein the guiding groove of the body has a beveled base section, in which the depth of the guiding groove increases at an open end of the same.

7. The refrigerating device as claimed in claim 1, wherein the guiding projection is impinged upon by a spring biased outwardly in the direction of the beam movement axis.

8. A refrigerating device comprising:

a body having a pair of interior edges disposed opposite to one another and together delimiting an opening in the body, and the body having a guiding groove;

a first door having an anchor edge secured to the body and a free edge opposite to its anchor edge;

a second door having an anchor edge secured to the body and a free edge opposite to its anchor edge, the first door and the second door each being movable between a respective open disposition and a respective closed disposition;

a beam movably secured to the first door proximate to the free edge of the first door and the beam being movable relative to the first door about a beam movement axis between a traversing position, when the first door and the second door are in their respective closed dispositions, in which the beam traverses the opening and in which the second door can, in the region of its free edge, engage the beam, and a non-traversing position when the first door is in its respective open disposition; and a guiding projection movably mounted on the first door, the guiding projection being movable relative to the first door in a direction generally parallel to the beam movement axis and the guiding projection of the first door and the guiding groove of the body engaging one another as the first door is moved from its open disposition into its closed disposition with engagement between the guiding projection of the first door and the guiding groove of the body assisting a movement of the beam from its non-traversing position into its traversing position, wherein the guiding projection, in the traversing position, blocks a gap between the top and/or bottom edge of the first door and the body in a substantially air tight fashion.

9. The refrigerating device as claimed in claim 8, wherein the guiding projection is additionally movable relative to the beam in a direction generally parallel to the beam movement axis.

10. The refrigerating device as claimed in claim 9, wherein the guiding projection has an arc-shaped cross section and the guiding projection is guided in a displaceable manner in a channel of the beam formed with a complementary arc-shaped cross-section.

11. The refrigerating device as claimed in claim 10, wherein the guiding projection on the first door includes an insertion bevel formed on the respective region of the guiding projection that initially engages the guiding groove of the body when the first door is closed, and the insertion bevel has a progressively reducing height in a direction from an entry portion thereof that is the first portion of the guiding projection to enter the guiding groove of the body towards an end portion of the guiding projection that thereafter enters the guiding groove of the body.

12. The refrigerating device as claimed in claim 11, wherein, in the traversing position of the beam, the entire length of the insertion bevel has seated into the guiding groove of the body.

13. The refrigerating device as claimed in claim 11, wherein the guiding groove has a beveled base section that engages with the insertion bevel as the beam is moved into its traversing position.

14. The refrigerating device as claimed in claim 10, wherein the guiding groove of the body has a beveled base section, in which the depth of the guiding groove increases at an open end of the same.

15. The refrigerating device as claimed in claim 8, wherein the guiding projection is impinged upon by a spring biased outwardly in the direction of the beam movement axis.

16. The refrigeration device as claimed in claim 8, wherein the guiding projection and the guiding groove have substantially complementary shapes, and the guiding projection is elongated in the direction of movement between the guiding projection and the guiding groove.

17. A refrigerating device comprising:

a body having a pair of interior edges disposed opposite to one another and together delimiting an opening in the body;

a first door having an anchor edge secured to the body and a free edge opposite to its anchor edge;

a second door having an anchor edge secured to the body and a free edge opposite to its anchor edge, the first door and the second door each being movable between a respective open disposition and a respective closed disposition;

a beam movably secured to the first door proximate to the free edge of the first door and the beam being movable relative to the first door about a beam movement axis between a traversing position, when the first door and the second door are in their respective closed dispositions, in which the beam traverses the body opening and in which the second door can, in the region of its free edge, engage the beam, and a non-traversing position when the first door is in its open disposition; and a guide projection and guide groove arrangement positioned within a gap located between the body and a top and/or bottom edge of the first door, the arrangement including an elongated guide projection and an elongated guide groove having substantially complimentary shapes progressively engaging one another as the first door is moved from its open disposition into its closed disposition with engagement between the guide projection and the guide groove assisting movement of the beam from its non-traversing position into its traversing position, wherein the elongated guide projection has at least one side wall surface and a base wall surface, at least one of which contacts a corresponding surface of the elongated guide groove over substantially its entire length.

18. The refrigeration device as claimed in claim 17, wherein the guide projection, in the traversing position, blocks each said gap in a substantially air tight fashion.

19. The refrigeration device as claimed in claim 17, wherein the guide projection is elongated in the direction of relative movement between the guide projection and the guide groove.

20. A refrigerating device comprising:

a body having a pair of interior edges disposed opposite to one another and together delimiting an opening in the body;

a first door having an anchor edge secured to the body and a free edge opposite to its anchor edge;

a second door having an anchor edge secured to the body and a free edge opposite to its anchor edge, the first door and the second door each being movable between a respective open disposition and a respective closed disposition;

a beam movably secured to the first door proximate to the free edge of the first door and the beam being movable relative to the first door about a beam movement axis between a traversing position, when the first door and the second door are in their respective closed dispositions, in which the beam traverses the body opening and in which the second door can, in the region of its free edge, engage the beam, and a non-traversing position when the first door is in its open disposition; and a guide projection and guide groove arrangement positioned within a gap located between the body and a top and/or bottom edge of the first door, the arrangement including an elongated guide projection and an elongated guide groove having substantially complimentary shapes progressively engaging one another as the first door is moved from its open disposition into its closed disposition with engagement between the guide projection and the guide groove assisting movement of the beam from its non-traversing position into its traversing position, wherein the guide projection, in the traversing position, blocks each said gap in a substantially air tight fashion.

* * * * *